United States Patent [19]

Wallace et al.

[11] 4,209,324

[45] Jun. 24, 1980

[54] TITANIUM-CONTAINING TREATMENT AGENTS FOR MOLTEN FERROUS METAL

[75] Inventors: John F. Wallace, Shaker Heights; Robert W. Neuman, North Ridgeville, both of Ohio

[73] Assignee: Foesco International Limited, Birmingham, United Kingdom

[21] Appl. No.: 953,953

[22] Filed: Oct. 23, 1978

[30] Foreign Application Priority Data

Oct. 21, 1977 [GB] United Kingdom ..... 43954/77

[51] Int. Cl.[2] ..... C22B 9/10

[52] U.S. Cl. ..... 75/58; 75/53; 75/129; 75/130 R; 75/257

[58] Field of Search ..... 75/257, 53, 58, 130 R, 75/129

[56] References Cited

U.S. PATENT DOCUMENTS

| | | | |
|---|---|---|---|
| 3,417,808 | 12/1968 | Rosenberg | 75/257 |
| 3,493,363 | 2/1970 | Ahearn | 75/257 |
| 3,849,211 | 11/1974 | Gurevich | 75/257 |

*Primary Examiner*—P. D. Rosenberg

*Attorney, Agent, or Firm*—Cushman, Darby & Cushman

[57] ABSTRACT

Titanium recovery in the treatment of molten ferrous metal e.g. in a furnace or ladle is improved if use is made of an agent comprising titanium metal and an alkali metal halide or an alkaline earth metal halide.

5 Claims, No Drawings

TITANIUM-CONTAINING TREATMENT AGENTS FOR MOLTEN FERROUS METAL

This invention relates to treating molten ferrous metals and to treatment agents containing titanium metal for use in such treatments.

Titanium metal is added to molten ferrous metals for a number of reasons. Titanium may be added to iron to control the structure of the graphite, to eliminate pinhole defects due to the presence of nitrogen when the iron is cast and to act as nuclei for austenitic dendrites during solidication of the iron, thereby improving the properties of the cast iron. Titanium also has a slight inoculating effect when added to molten iron. Titanium may be added to molten steel to remove oxygen, and also to combine with any nitrogen present so as to prevent pinhole defects in the cast steel and to avoid embrittlement which could result from the nitrogen combining with any aluminium present to form aluminium nitride.

Usually titanium is added to molten ferrous metals in the form of ferrotitanium or titanium sponge. However recovery of the titanium i.e. the percentage of titanium added retained in the cast metal is often poor so that the desired benefits from the addition of the titanium are not achieved or the benefits are only achieved by using relatively excessive quantities of titanium.

It has now been found that titanium recovery in molten ferrous metals can be improved if the titanium is added in conjunction with an alkali metal or alkaline earth metal halide fluxing agent. Such improvements are not obtained if the titanium and fluxing agent are added in sequence, in either order.

According to a first feature of the present invention there is provided a process for the introduction of titanium into a molten ferrous metal which comprises adding to the molten ferrous metal a treatment agent comprising titanium and a halide selected from the class of one or more alkali metal halides and alkaline earth metal halides.

Suitable alkali metal or alkaline earth metal halides include sodium chloride, potassium chloride, sodium fluoride, potassium fluoride and calcium fluoride. Complex alkali metal halides such as potassium aluminium fluoride and sodium aluminium fluoride may also be used.

The present invention specifically provides treatment compositions for use in the above process which comprise in intimate admixture, titanium and a fluxing agent comprising sodium chloride and potassium chloride.

The treatment agent will usually comprise 30 to 90% by weight titanium and 10 to 70% by weight alkali metal and/or alkaline earth metal halide.

The treatment agent may be produced by mixing together particulate titanium, for example in the form of chips or powder, and alkali and/or alkaline earth metal halide powder. In order to give the treatment agent handlability, the resulting mixture is preferably compacted e.g. to compacts or tablets.

It is not usually necessary to incorporate a binder in the mixture in order to produce such treatment agent compacts or tablets, since the alkali metal and/or alkaline earth metal halide salts themselves act as binders. However, if desired a binder such as a gum or a natural or synthetic resin may be used.

The size of such tablets may vary but tablets of the order of 2.5 inches in diameter and 0.75 inches thick have been found to be particularly useful.

When used to treat molten ferrous metal the rate of addition of the treatment agent will vary depending on the titanium content of the treatment agent and the quantity of titanium it is desired to introduce into the metal. For a treatment agent consisting of 66% titanium and 34% alkali and/or alkaline earth metal halide a typical addition rate is 2 lb per ton of molten metal for a 0.05% titanium addition. Using treatment agents according to the invention a titanium recovery of at least 75%, typically 75 to 100%, will normally be obtained.

The treatment agent may be used to treat molten metal in a furnace or in a ladle. Titanium recovery will tend to be higher in a furnace (of the order of 90%) than in a ladle (of the order of 80%).

The following example will serve to illustrate the invention:

A treatment agent was prepared by compacting into tablets the following composition (percentages by weight):

| | |
|---|---|
| titanium chip | 66% |
| sodium chloride | 17% |
| potassium chloride | 17% |

The tablets produced were used in a series of tests:

(1) Tablets were used to treat molten grey iron (in which it was desired to pick up 0.05% titanium) in an induction furnace in two separate trials. In each of the trials a 3500 lb casting was cast from the treated iron. Titanium recoveries were 80 to 85% compared with 30 to 40% when using ferrotitanium according to regular practice.

(2) Tablets were used to treat molten grey iron in a ladle and gave a recovery of 80% compared with 26 to 40% using ferrotitanium.

(3) Tablets were used to treat molten steel in a ladle and gave an average titanium recovery of 80 to 85%.

(4) Tablets were used to treat a low carbon, high silicon, low sulphur grey iron in a ladle at various temperatures, and the following results were obtained:

| Weight of metal treated lb | Temperature °F. | Titanium Addition lb | Titanium Recovery % |
|---|---|---|---|
| 94.8 | 2600 | 0.352 | 75 |
| 64.6 | 2650 | 0.355 | 87 |
| 88.8 | 2700 | 0.358 | 100 |

These results indicate the increase in titanium recovery when the titainium is used as a tablet according to the invention.

We claim:

1. In a process for the introduction of titanium into a molten ferrous metal located in a furnace or ladle the improvement which comprises adding a treating agent which is in the form of a compact consisting essentially of titanium and at least one alkali metal halide in order to obtain a titanium recovery of at least 75%.

2. A process according to claim 1, in which the halide is selected from the class consisting of sodium chloride, potassium chloride, sodium fluoride and potassium fluoride.

3. A process according to claim 1, in which the treating agent comprises 30 to 90% by weight titanium and 10 to 70% by weight of said halide.

4. A process according to claim 1, in which said compact is a tablet which additionally includes a binder.

5. A process according to claim 1 wherein the treating agent is a tablet containing both sodium chloride and potassium chloride.

* * * * *